US008449334B2

(12) United States Patent
Wang

(10) Patent No.: US 8,449,334 B2
(45) Date of Patent: May 28, 2013

(54) CARD EDGE CONNECTOR

(75) Inventor: Yong Fu Wang, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 40 days.

(21) Appl. No.: 13/346,509

(22) Filed: Jan. 9, 2012

(65) Prior Publication Data

US 2013/0090016 A1 Apr. 11, 2013

(30) Foreign Application Priority Data

Oct. 7, 2011 (CN) ..... 2011 2 0369322 U

(51) Int. Cl.
*H01R 24/00* (2011.01)

(52) U.S. Cl.
USPC ..... 439/630; 439/862

(58) Field of Classification Search
USPC ..... 439/630, 629, 733.1, 541.5, 862
See application file for complete search history.

(56) References Cited

U.S. PATENT DOCUMENTS

| | | | | |
|---|---|---|---|---|
| 6,176,737 | B1 * | 1/2001 | Choy | 439/541.5 |
| 6,666,702 | B1 * | 12/2003 | Pickles | 439/328 |
| 6,926,565 | B2 * | 8/2005 | Fogg | 439/862 |
| 7,025,617 | B2 * | 4/2006 | Regnier et al. | 439/329 |
| 7,427,208 | B2 * | 9/2008 | Yang et al. | 439/326 |
| 7,445,497 | B2 * | 11/2008 | Zhang | 439/541.5 |
| 7,556,527 | B2 * | 7/2009 | Li et al. | 439/541.5 |
| 2011/0086552 | A1 * | 4/2011 | Yao et al. | 439/633 |

* cited by examiner

*Primary Examiner* — Briggitte R Hammond
(74) *Attorney, Agent, or Firm* — Morris Manning & Martin LLP; Tim Tingkang Xia, Esq.

(57) ABSTRACT

A card edge connector includes an insulating body having a base body, multiple first terminals, and multiple second terminals. A first body and a second body extend from a front end of the base body sequentially from bottom to top. Multiple recessed first receiving slots are disposed at the first body. A recessed first retaining slot is disposed at the first body and a side wall of each of the first receiving slots. Each of the first terminals has a first retaining portion retained in the first retaining slot with a first connecting portion bent and extends laterally thereof. A first elastic section extends forwards from the first connecting portion and located in the first receiving slot. A first contact arm extends forwards from the rear end of the first elastic section and has a first contact portion which enters the first insertion space.

10 Claims, 10 Drawing Sheets

CARD EDGE CONNECTOR

CROSS-REFERENCE TO RELATED APPLICATIONS

This non-provisional application claims priority under 35 U.S.C. §119(a) on Patent Application No. 201120369322.5 filed in P.R. China on Oct. 7, 2011, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention generally relates to a card edge connector, and more particularly to a card edge connector for electrically connecting an electronic card to a circuit board.

BACKGROUND OF THE INVENTION

A conventional card edge connector 100, as shown in FIG. 1, includes an insulating body 10, and multiple first terminals 11 and multiple second terminals 12 received in the insulating body. The insulating body 10 includes a base body 1. A first body 2 and a second body 3 extend forwards from the base body 1. The second body 3 is above the first body 2. The first body 2, the second body 3, and the base body 1 collectively enclose an insertion space 4 into which an electronic card (not shown) is received and fixed. The first body 2 is disposed with multiple recessed first receiving slots 21 in communication with the insertion space 4. A rear wall of each of the first receiving slots 21 is further disposed with a recessed retaining slot 22 partially located in the base body 1. The second body 3 is disposed with multiple recessed second receiving slots (not shown) in communication with the insertion space 4. Each of the first terminals 11 has a first retaining portion 111 retained in the retaining slot 22. A first contact arm 112 extends forwards from a front end of the first retaining portion 111. The first contact arm 112 has a first contact portion 112*a*, which enters the insertion space 4 and is pressed by the electronic card (not shown) to electrically contact with the electronic card (not shown). Each of the second terminals 12 is received in one of the second receiving slots (not shown), and partially exposed in the insertion space to electrically contact with the electronic card (not shown).

In the card edge connector 100, the first contact arm 112 directly extends forwards from the first retaining portion 111, and the first retaining portion 111 is close to the first contact portion 112*a*, so that an elastic arm of the first contact arm 112 is not long enough, thereby resulting in poor elasticity. Therefore, when the first contact arm 112 is pressed by the electronic card (not shown) for a long time, the first contact arm 112 gets fatigued easily due to the poor elasticity.

Therefore, a heretofore unaddressed need exists in the art to address the aforementioned deficiencies and inadequacies.

SUMMARY OF THE INVENTION

In one aspect, the present invention is directed to a card edge connector, in which a first contact arm has a long elastic arm, thereby achieving excellent elasticity to avoid getting fatigued easily.

In one embodiment, a card edge connector according to the present invention includes an insulating body, multiple first terminals and multiple second terminals. The insulating body includes a base body disposed lengthwise. A first body and a second body extend forwards from the base body. The second body is above the first body. The first body, the second body, and the base body collectively enclose a first insertion space. The first body is disposed with multiple recessed first receiving slots. The second body is disposed with multiple recessed second receiving slots. The first receiving slots and the second receiving slots are all in communication with the first insertion space. A recessed first retaining slot is disposed at the first body and a side wall of each of the first receiving slots. Each of the first terminals has a first retaining portion retained in the first retaining slot. A first connecting portion is bent and extends laterally from the first retaining portion. A first elastic section extends backwards from the first connecting portion and is located in the receiving slot. A first contact arm extends forwards from a rear end of the first elastic section. Each of the first contact arms has a first contact portion which enters the first insertion space. A first soldering portion extends downwards from the first retaining portion and is exposed on a bottom surface of the first body. Each of the second terminals includes a second contact arm received in the second receiving slot, and each of the second contact arms has a second contact portion, which enters the first insertion space.

In another embodiment, the first terminal further includes a first interconnecting portion interconnecting the first retaining portion and the first soldering portion. The first interconnecting portion extends downwards from the first retaining portion. A recessed first channel is disposed on a front end surface of the first body and runs to a bottom wall of the first retaining slot. The first interconnecting portion is received in the first channel. Alternatively, the first terminal further includes a first interconnecting portion interconnecting the first retaining portion and the first soldering portion. The first interconnecting portion extends downwards from the first retaining portion and extends backwards to be formed. A recessed first channel is disposed on a front end surface of the first body and runs to a bottom wall of the first retaining slot. A recessed second channel is disposed on the bottom surface of the first body and in communication with the first channel. The first channel and the second channel collectively receive the first interconnecting portion. A third body extends forwards from the base body and is located above the second body. The second body, the third body, and the base body collectively enclose a second insertion space. Multiple recessed third receiving slots are disposed on the second body. Multiple recessed fourth receiving slots are disposed on the third body. The third receiving slots and the fourth receiving slots are all in communication with the second insertion space. The card edge connector further includes multiple third terminals and multiple fourth terminals. Each of the third terminals includes a third contact arm received in the third receiving slot. Each of the third contact arms has a third contact portion which enters the second insertion space. Each of the fourth terminals includes a fourth contact arm received in the fourth receiving slot. Each of the fourth contact arms has a fourth contact portion which enters the second insertion space. The first contact arm and the third contact arm are coplanar. A third soldering arm extends downwards from the third contact arm, enters the first body, and is located under the first contact arm. The third soldering arm has a third soldering portion exposed on the bottom surface of the first body. The first soldering portion is closer to the base body than the third soldering portion. The first receiving slot is recessed backwards into the base body, and the first elastic section and a rear end of the first contact arm are received in the base body. The first receiving slot runs to a top surface and a front end surface of the first body. The first retaining slot runs to the front end surface of the first body. The first retaining portion urges against an upper wall surface and a lower wall surface of the first retaining slot.

In the embodiments of the present invention, the first elastic section extends backwards from the first connecting portion, the first contact arm extends forwards from the rear end of the first elastic section, that is, the first contact arm is formed by bending and extending the first connecting portion backwards and then forwards, totally twice, so that the length of the elastic arm of the first contact arm is the sum of the length of the first contact arm and the length of the first elastic section, which is equivalent to that the length of the elastic arm of the first contact arm is increased by the length of the first elastic section. Therefore, the elastic arm of the first contact arm is long and elastic, thereby preventing the first contact arm from getting fatigued easily after being pressed long by an electronic card.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
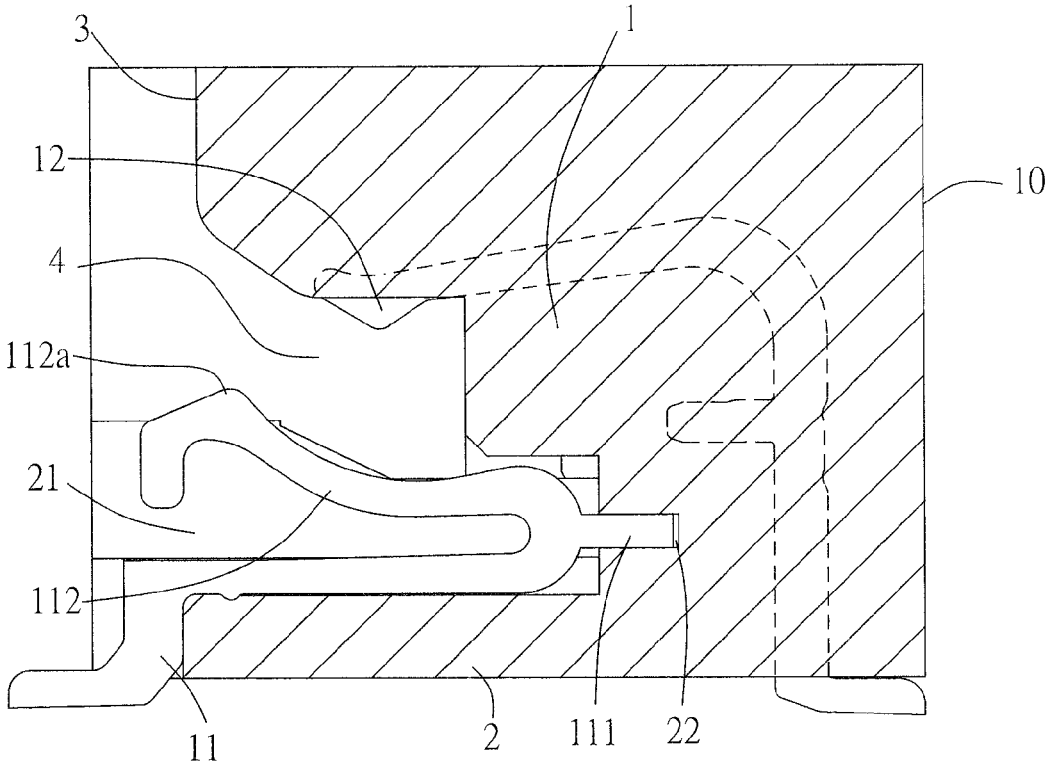
FIG. 1 (Related Art)
FIG. 1 is a view of the related art of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
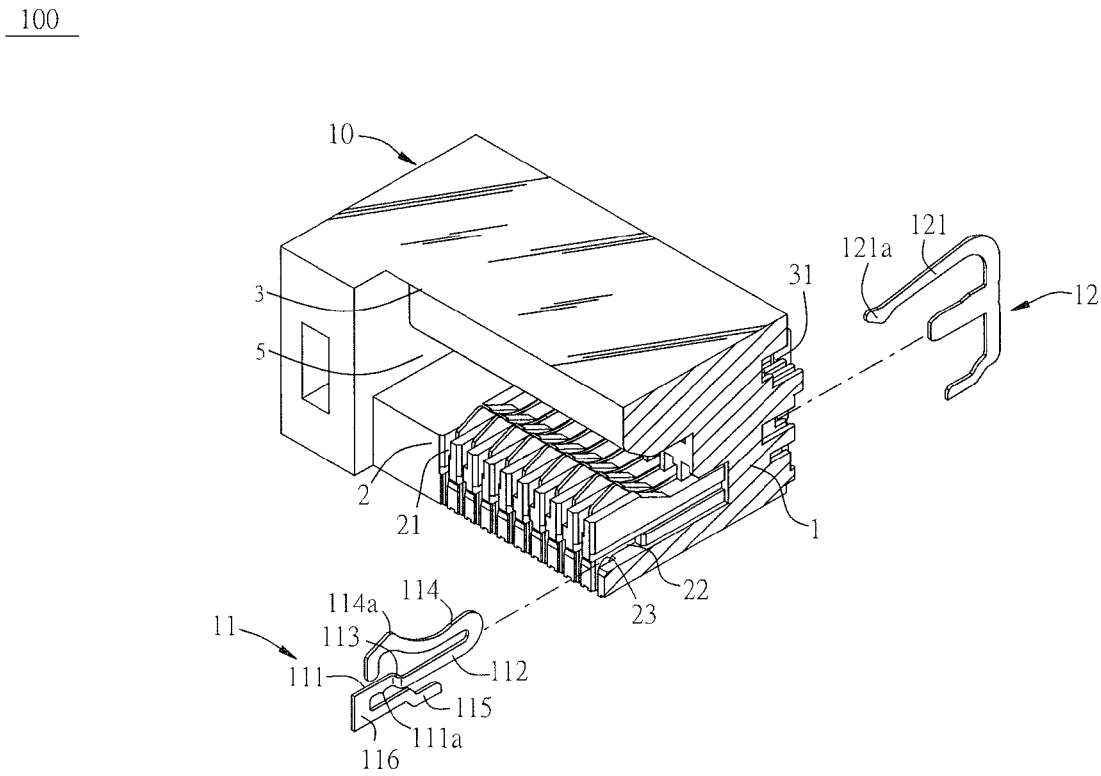
FIG. 2 is a three-dimensional exploded view of a first embodiment of a card edge connector according to the present invention.
Figure 3:
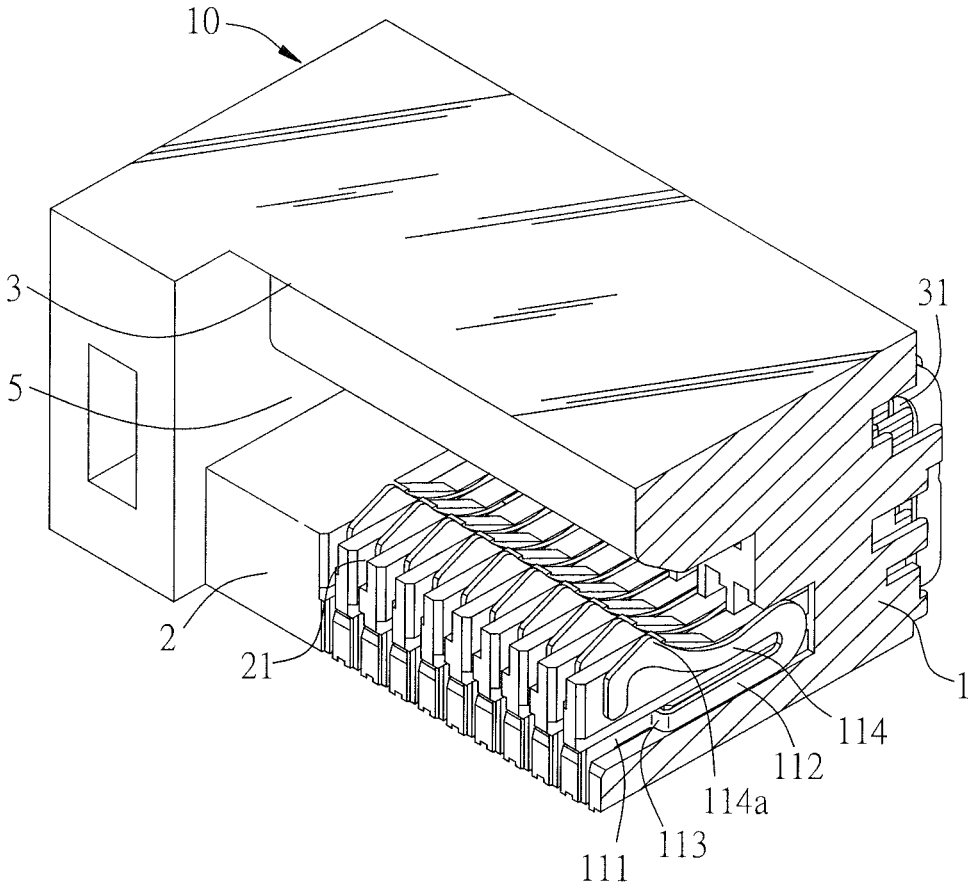
FIG. 3 is a three-dimensional assembly view of the first embodiment of the card edge connector according to the present invention.

Referring to FIG. 2 and FIG. 3, a first embodiment of the present invention is described briefly below. A card edge connector 100 is a single layer card edge connecter, and includes an insulating body 10 having a base body 1 disposed lengthwise. A first body 2 and a second body 3 extend forwards from the base body 1. The second body 3 is above the first body 2. The first body 2, the second body 3, and the base body 1 collectively enclose a first insertion space 5. The first body 2 is disposed with multiple recessed first receiving slots 21, and the second body 3 is disposed with multiple recessed second receiving slots 31. The first receiving slots 21 and the second receiving slots 31 are all in communication with the first insertion space 5. A recessed first retaining slot 22 is disposed at the first body 2 and a side wall of each of the first receiving slots 21.

Multiple first terminals 11 are secured in the first receiving slots 21. Each of the first terminals 11 has a first retaining portion 111 retained in the first retaining slot 22. A first connecting portion 113 is bent and extends laterally from the first retaining portion 111. A first elastic section 112 is bent and extends backwards from the first connecting portion 113, and is received in the first receiving slot 21. A first contact arm 114 extends forwards from a rear end of the first elastic section 112. Each of the first contact arms 114 has a first contact portion 114*a*, which enters the first insertion space 5. A first soldering portion 115 extends downwards from the first retaining portion 111, and is exposed on a bottom surface of the first body 2. Multiple second terminals 12 are received in the second receiving slots 31. Each of the second terminals 12 includes a second contact arm 121. Each of the second contact arms 121 has a second contact portion 121*a*, which enters the first insertion space 5.

FIGS. 4-10 are a second embodiment of the card edge connector 100 according to the present invention, and the embodiment is a common embodiment in actual applications. The card edge connector 100 of the present invention is further described below with reference to FIGS. 4-10 and the specific embodiment.

Figure 4:
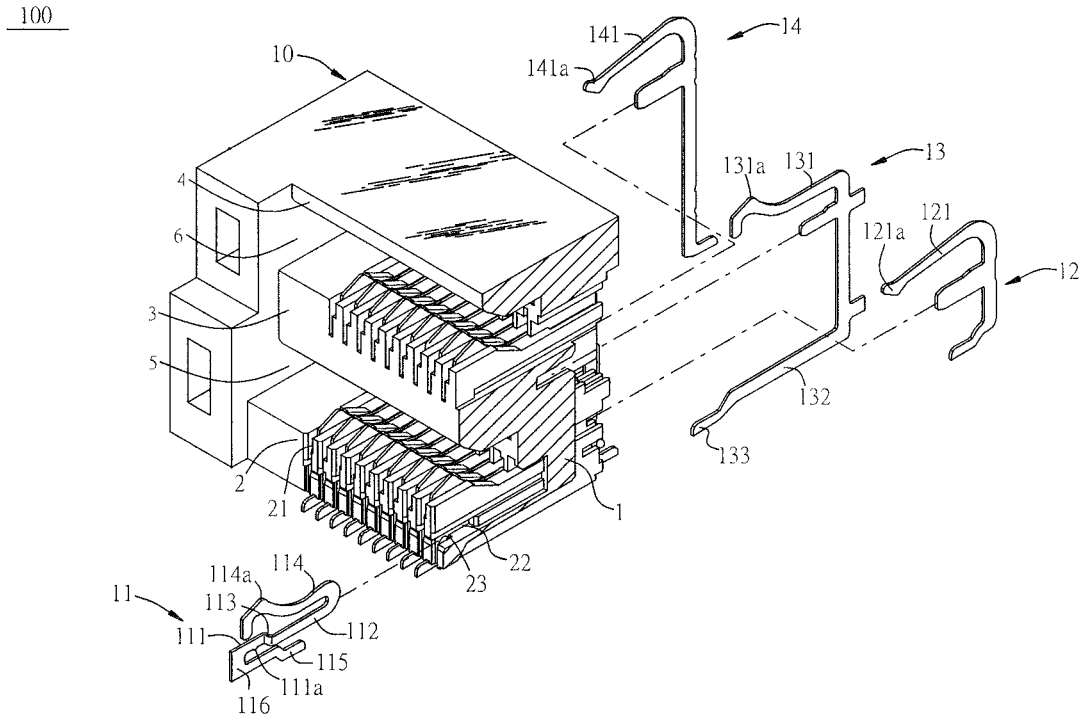
FIG. 4 is a three-dimensional exploded view of a second embodiment of the card edge connector according to the present invention.

Referring to FIG. 4, the embodiment of the card edge connector 100 according to the present invention is a dual-layer card edge connector, and includes an insulating body 10, and multiple first terminals 11, multiple second terminals 12, multiple third terminals 13, and multiple fourth terminals 14 received in the insulating body 10.

Referring to FIG. 4, the insulating body 10 includes a base body 1 disposed lengthwise. A first body 2, a second body 3, and a third body 4 extend forwards from the base body 1, and are disposed sequentially from bottom to top. That is to say, the second body 3 is above the first body 2, and the third body 4 is above the second body 3. The first body 2, the second body 3, and the base body 1 collectively enclose a first insertion space 5 into which a first electronic card (not shown) is received and fixed. The second body 3, the third body 4, and the base body 1 collectively enclose a second insertion space 6 into which a second electronic card (not shown) is received and fixed.

Referring to FIGS. 4-7, multiple recessed first receiving slots 21 are disposed on a lower wall of the first insertion space 5, that is, on the first body 2. Each of the first receiving slots 21 runs to a top surface and a front end surface of the first body 2, so that the first receiving slot 21 is in communication with the first insertion space 5 and has two open sides. Therefore, the first terminal 11 can be mounted into the insulating body 10 from the front of the insulating body 10. In this embodiment, each of the first receiving slots 21 is recessed backwards to be disposed in the base body 1, so that the first receiving slots 21 are large enough in a front-rear direction. Therefore, the first terminal 11 can be conveniently disposed in the front-rear direction. A recessed first retaining slot 22 is further disposed on the first body 2 and on a side wall (a left side wall or a right side wall) of the first receiving slot 21. The first retaining slot 22 runs to the front end surface of the first body 2, and the first retaining slot 22 has an upper wall surface and a lower wall surface used to collectively hold and fix the first terminal 11.

Figure 5:
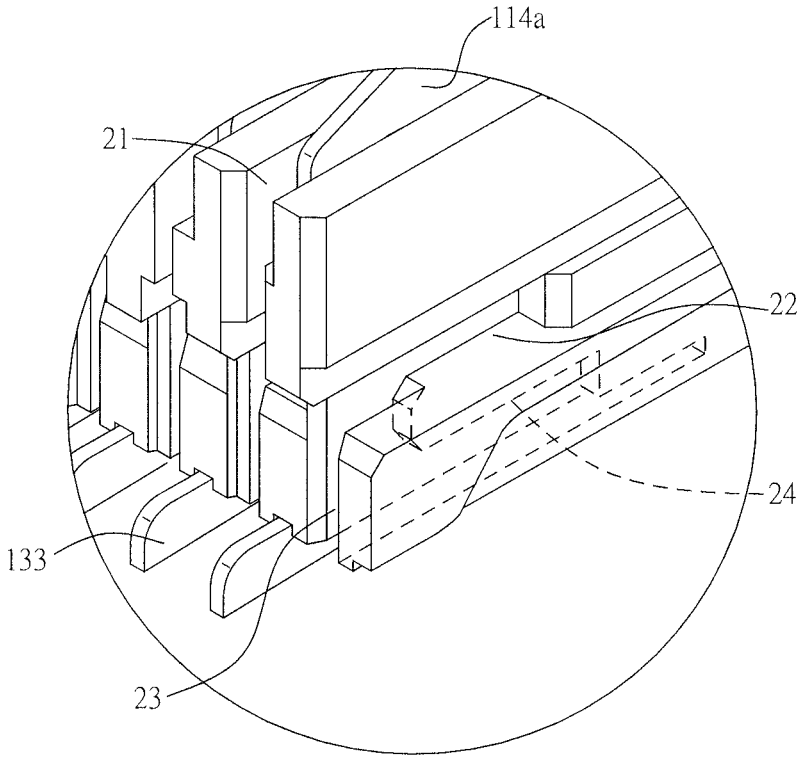
FIG. 5 is a partially enlarged view of FIG. 4.
Figure 7:
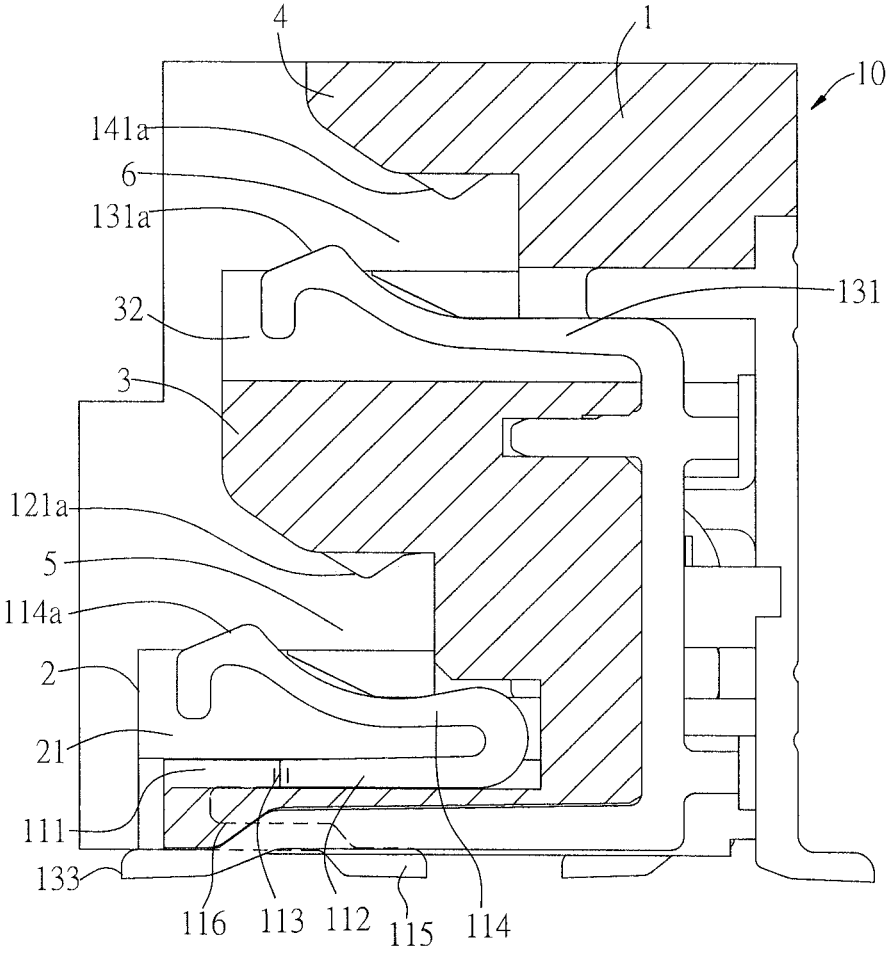
FIG. 7 is a cutaway view of the second embodiment of the card edge connector according to the present invention.

Referring to FIG. 4, FIG. 5, and FIG. 7, a recessed first channel 23 is disposed on the front end surface of the first body 2, and runs upwards to a bottom wall of the first retaining slot 22, so that the first retaining slot 22 is in communication with the first channel 23. In this embodiment, a recessed second channel 24 is disposed on the bottom surface of the first body 2, and is in communication with the first channel 23. The first receiving slot 21, the first retaining slot 22, the first channel 23, and the second channel 24 are used to collectively receive and fix the first terminal 11, definitely the design is not limited thereto, and whether the second channel 24 is opened depends on specific design of the first terminal 11.

Figure 6:
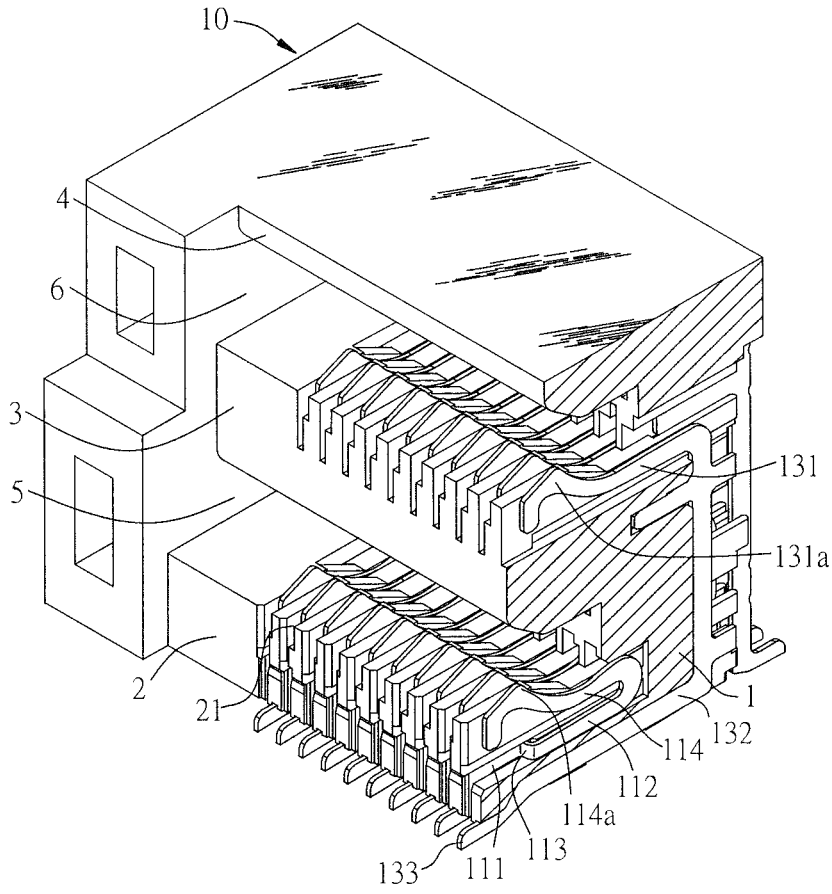
FIG. 6 is a three-dimensional cutaway view of the second embodiment of the card edge connector according to the present invention.
Figure 8:
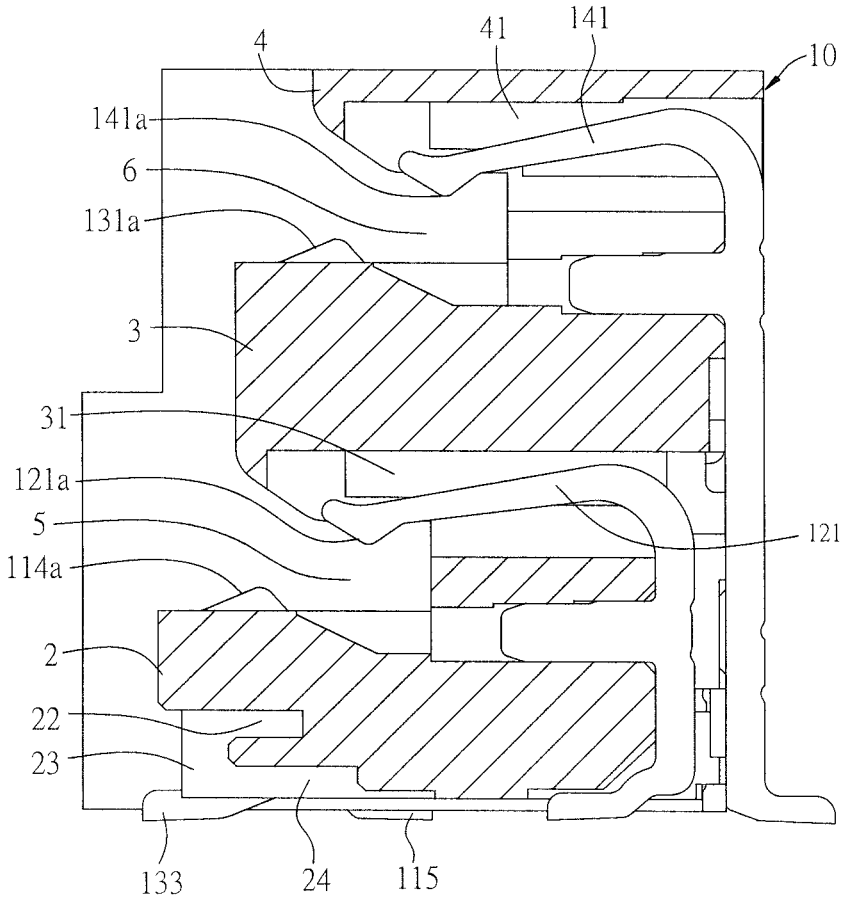
FIG. 8 is another cutaway view of the second embodiment of the card edge connector according to the present invention.

Referring to FIG. 4, FIG. 6, and FIG. 8, multiple recessed second receiving slots 31 and multiple recessed third receiving slots 32 are disposed on the second body 3 respectively, and respectively form a row. Each of the second receiving slots 31 runs downwards to the bottom surface of the second body 3, so that the second receiving slots 31 are in communication with the first insertion space 5, and run to a rear end surface of the base body 1. Therefore, the second terminal 12 can be mounted into the insulating body 10 from the back of the insulating body 10, as shown in FIG. 2. The third receiving slot 32 runs forwards to a front end surface of the second body 3 and upwards to a top surface of the second body 3 to enable the third receiving slot 32 to be in communication with the second insertion space 6, and runs backwards to the rear end surface of the base body 1, so that the third terminal 13 can be mounted into the insulating body 10 from the back of the insulating body 10, as shown in FIG. 2.

Referring to FIG. 4, FIG. 6, and FIG. 8, multiple recessed fourth receiving slots 41 are disposed on the third body 4. The fourth receiving slot 41 runs downwards to the bottom surface of the third body 4 to enable the fourth receiving slot 41 to be in communication with the second insertion space 6, and runs backwards to the rear end of the base body 1, so that the fourth terminal 14 can also be mounted into the insulating body 10 from the back of the insulating body 10.

Figure 9:
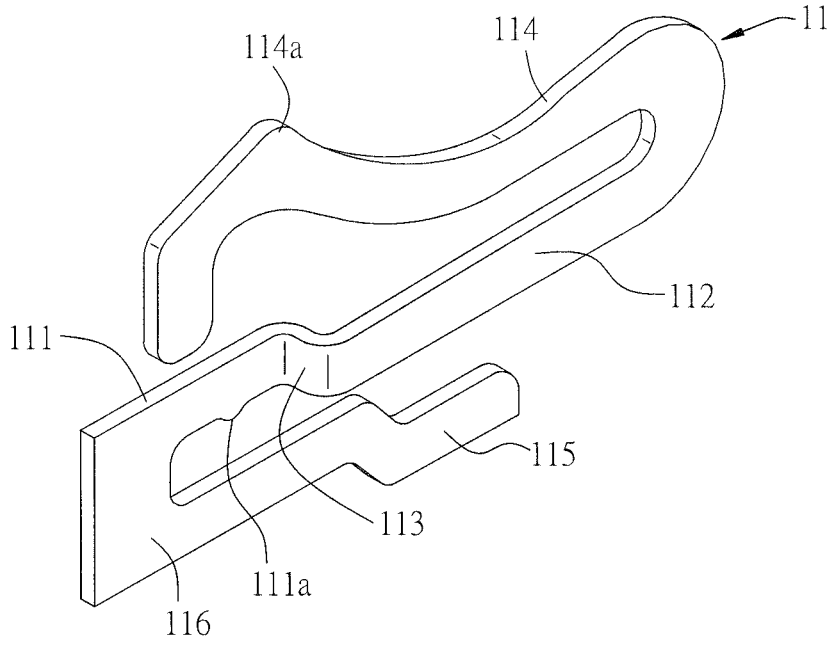
FIG. 9 is a three-dimensional view of a first terminal in the second embodiment of the card edge connector according to the present invention.
Figure 10:
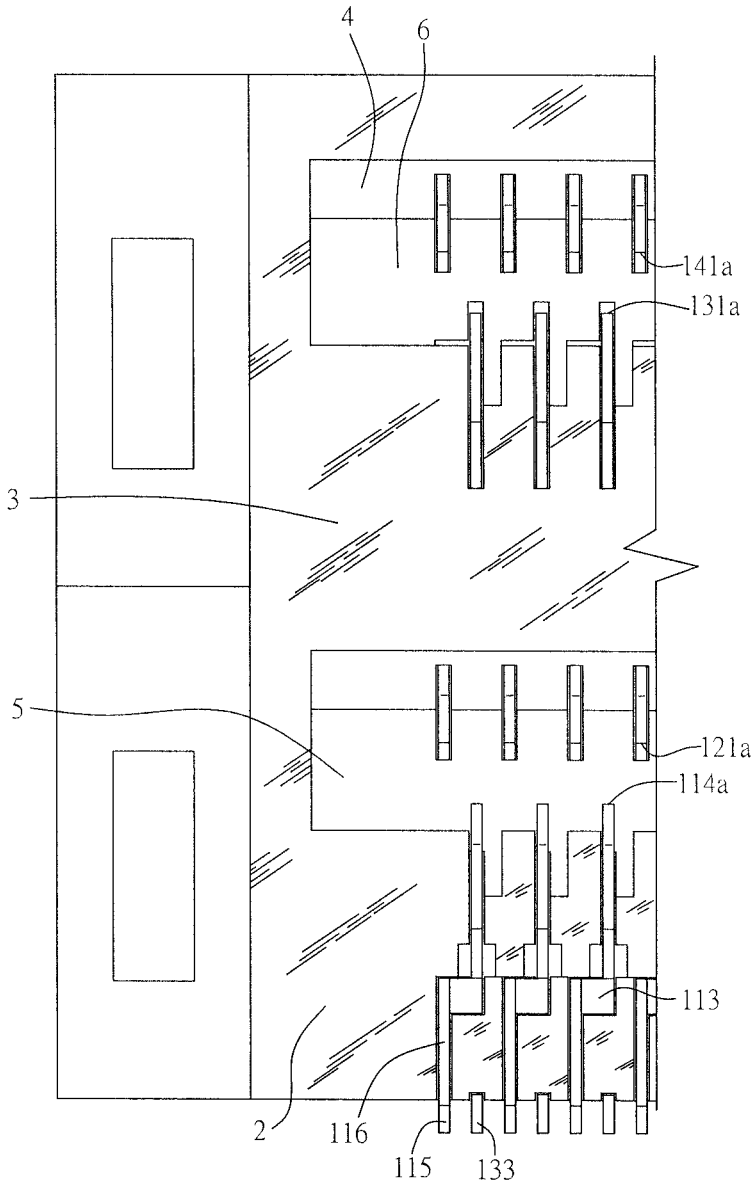
FIG. 10 is a schematic front view of FIG. 6.

Referring to FIG. 4, FIG. 7, and FIG. 9, each of the first terminals 11 has a first retaining portion 111 retained in the first retaining slot 22. An upper end of the first retaining portion 111 urges against an upper wall surface of the first retaining slot 22, a lower end of the first retaining portion 111 urges against a lower wall surface of the first retaining slot 22, so that interference fit is achieved between the first retaining portion 111 and the first retaining slot 22. In this embodiment, in order to enable the first retaining portion 111 to be better fit with the first retaining slot 22, a protruding thorn 111*a* is disposed at a lower end of the first retaining portion 111. Referring to FIG. 7 and FIG. 8, a first connecting portion 113 is bent and extends laterally from the first retaining portion 111. A first elastic section 112 extends backwards from the first connecting portion 113, and is received in the first receiving slot 21. The first elastic section 112 and the first retaining portion 111 are staggered laterally, that is, in different planes. The first connecting portion 113 connects the first elastic section 112 to the first retaining portion 111.

A first contact arm 114 extends forwards from a rear end of the first elastic section 112. The first contact arm 114 and the first elastic section 112 are coplanar. The first contact arm 114 has a first contact portion 114*a*, which enters the first insertion space 5, so that the first contact portion 114*a* can be connected to a first electronic card (not shown) in a pressed manner, so as to be electrically connected to the first electronic card (not shown). In this embodiment, in order to enable the first contact arm 114 to have a longer elastic arm to achieve better elasticity, the first elastic section 112 partially extends into the base body 1, so that the elastic section 112 and a rear end of the first contact arm 114 are received in the base body 1 without interfering with each other, and the elastic arm of the first contact arm 114 is longer and more elastic.

A first soldering portion 115 extends downwards from a front end of the first retaining portion 111, and is disposed on the bottom surface of the first body 2. The first soldering portion 115 and the first contact arm 114 are not in the same plane, that is, are staggered laterally. In this embodiment, the first terminal 11 further includes a first interconnecting portion 116 received in the first channel 23 and the second channel 24. The first interconnecting portion 116 interconnects the first retaining portion 111 and the first soldering portion 115. The first interconnecting portion 116 extends downwards from the first retaining portion 111, and then extends backwards to be formed, definitely the design is not limited thereto, the first interconnecting portion 116 may also directly extend downwards from a front end of the first retaining portion 111 to be formed, and in this case the first interconnecting portion 116 is only received by the first channel 23, and the second channel 24 does not need to be disposed.

Referring to FIG. 4, FIG. 6, and FIG. 8, each of the second terminals 12 includes a second contact arm 121 received in the second receiving slot 31. Each of the second contact arms 121 has a second contact portion 121*a*, which enters the first insertion space 5, so that the second contact portion 121*a* can be connected to the first electronic card (not shown) in a pressed manner, so as to be electrically connected to the first electronic card (not shown).

Referring to FIG. 4, FIG. 6, and FIG. 7, each of the third terminals 13 includes a third contact arm 131 received in the third receiving slot 32. Each of the third contact arms 131 has a third contact portion 131*a*, which enters the second insertion space 6, so that the third contact portion 131*a* can be connected to the second electronic card (not shown) in a pressed manner, so as to be electrically connected to the second electronic card (not shown). A third soldering portion 133 extends downwards from a rear end of the third contact arm 131, is exposed on the bottom surface of the insulating body 10, and is soldered to be fixed on the circuit board (not shown). In this embodiment, the three soldering portions 133 are exposed on the bottom surface of the first body 2. Alternatively, in other embodiments, the three soldering portions 133 may be exposed on the bottom surface of the base body 1.

Referring to FIG. 4 to FIG. 10, in this embodiment, when positions of contact points on the first electronic card (not shown) and the second electronic card (not shown) are taken into account, and when terminals (including the first terminals 11, the second terminals 12, the third terminals 13, and the fourth terminals 14) are required to be disposed on the insulating body 10 densely, the first contact arm 114 and the third contact arm 131 are coplanar, and the first contact portion 114*a* and the third contact portion 131*a* are coplanar.

In addition, based on the above, that is, the first contact arm 114 and the third contact arm 131 are coplanar and the terminals on the card edge connector 100 can be disposed densely, and when arrangement of solder pads on the circuit board (not shown) is taken into account, the first soldering portion 115 and the third soldering portion 133 are staggered laterally (in a left-right direction) and in a front-rear direction, and the third soldering portion 133 is required to be placed in front of the first contact portion 114*a*, that is the first soldering portion 115 is closer to the base body 1 than the third soldering portion 133. In order to achieve the design, in this embodiment, a third soldering arm 132 extends downwards from the third contact arm 131, enters the first body 2, and is located under the first contact arm 114. Each of the third soldering arms 132 has the third soldering portion 133 exposed on the bottom surface of the first body 2. The third soldering portion 133 is in front of the first contact portion 114*a*, and close to the front end surface of the first body 2.

In view of the above, the first contact arm 114 and the third contact arm 131 are coplanar. The third soldering arm 132 extends into the first body 2, is located under the first contact arm 114, and occupies the space under the first contact arm 114 and in the first body 2. Furthermore, in order to be adapted for the trend of becoming lighter and thinner, the first body 2 is usually disposed to be thin, so that the first body 2 under the first contact arm 114 is so small in a vertical direction, that no recessed slot can be opened in the first body 2 under the first contact arm 114 to fix and hold the first terminals 11. In addition, the third soldering arm 132 occupies the space under the first contact arm 114 and in the first body 2, thereby preventing the first soldering portion 115 from being disposed in a direction toward the base body 1. However, in this embodiment, the first retaining portion 111 is deviated laterally relative to the first contact arm 114, that is, connected to the first elastic section 112 by the first connecting portion 113 bent and extending laterally, so that the recessed first retaining slot 22 may be disposed on the side wall of the first receiving slot 21 to retain the first retaining portion 111, thereby solving the problem in which the first body 2 is so small in the vertical direction that the retaining slots for retaining the first terminals 11 cannot be disposed. Additionally, the first soldering portion 115 extends downwards from the first retaining portion 111, so that the part, under the first retaining portion 111, of the first terminals 11 deviates laterally relative to a plane where the first contact arm 114 and the third contact arm 131 are located, that is, is not coplanar with the first contact arm 114 or the third contact arm 131. Therefore, the third soldering portion 133 does not prevent the first soldering portion 115 from being disposed in the direction toward the base body 1.

Referring to FIG. 4, FIG. 6, and FIG. 8, in the multiple fourth terminals 14, each of the fourth terminals 14 includes a fourth contact arm 141 received in the fourth receiving slot 41. Each of the fourth contact arms 141 has a fourth contact portion 141*a*, which enters the second insertion space 6, so that the fourth contact portion 141*a* can be connected to the second electronic card (not shown) in a pressed manner, so as to be electrically connected to the second electronic card (not shown).

In summary, the card edge connector 100 according to the present invention, among other things, has the following beneficial effects.

1. In the present invention, the first elastic section 112 extends backwards from the first connecting portion 113, the first contact arm 114 extends forwards from the rear end of the first elastic section 112, that is, the first contact arm 114 is formed by bending and extending the first connecting portion 113 backwards and then forwards, totally twice, so that the length of the elastic arm of the first contact arm 114 is the sum of the length of the first contact arm 114 and the length of the first elastic section 112, which is equivalent to that the length of the elastic arm of the first contact arm 114 is increased by the length of the first elastic section 112. Therefore, the elastic arm of the first contact arm 114 is elongated and elastic, thereby preventing the first contact arm 114 from getting fatigued easily after being frequently pressed by the first electronic card (not shown).

2. In the second embodiment of the present invention, the first contact arm 114 and the third contact arm 131 are coplanar, the first connecting portion 113 interconnects the first retaining portion 111 and the first elastic section 112, and the first connecting portion 113 is bent and extends laterally from the first retaining portion 111 to be formed, so that the first connecting portion 113 deviates laterally relative to the plane where the first elastic section 112, the first contact arm 114, and the third contact arm 131 are located, and the parts under the first retaining portion 111, of the first terminals 11 (including the first interconnecting portion 116 and the first soldering portion 115) all deviate laterally relative to the plane where the first elastic section 112, the first contact arm 114, and the third contact arm 131 are located, thereby preventing arrangement of the first terminal 11 and the arrangement of the third soldering arm 132 from interfering with each other. During specific design, the third soldering arm 132 may be arranged to be in the first body 2 and under the first contact arm 114, and the first soldering portion 115 may be arranged to be behind the third soldering portion 133 and under the insulating body 10. Therefore, the first soldering portion 115 does not exceed the space occupied by the insulating body 10 on the circuit board (not shown).

3. In the second embodiment according to the present invention, when the terminals (the first terminals 11, the second terminals 12, the third terminals 13, and the fourth terminals 14) are disposed densely, the first soldering portion 115 and the third soldering portion 133 are staggered in the front-rear direction laterally (in the left-right direction), so that a distance between two adjacent soldering portions (the first soldering portions 115 or the third soldering portions 133) is increased, thereby facilitating soldering.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A card edge connector, comprising:

(a) an insulating body having a base body disposed lengthwise, wherein a first body and a second body extend forwards from the base body, the second body is above the first body, and the first body, the second body, and the base body collectively enclose a first insertion space; and wherein the first body is disposed with multiple recessed first receiving slots, the second body is disposed with multiple recessed second receiving slots, the first receiving slots and the second receiving slots are all in communication with the first insertion space, and a recessed first retaining slot is disposed at the first body and a side wall of each of the first receiving slots;

(b) multiple first terminals, wherein each of the first terminals comprises a first retaining portion retained in the first retaining slot;

a first connecting portion bent and extended laterally from the first retaining portion;

a first elastic section extended backwards from the first connecting portion and located in the first receiving slot;

a first contact arm extended forwards from a rear end of the first elastic section, each of the first contact arms has a first contact portion which enters the first insertion space; and a first soldering portion extended downwards from the first retaining portion and exposed on a bottom surface of the first body; and (c) multiple second terminals, wherein each of the second terminals comprises a second contact arm received in the second receiving slot, and each of the second contact arms has a second contact portion which enters the first insertion space.

2. The card edge connector according to claim 1, wherein the first terminal further comprises a first interconnecting portion interconnecting the first retaining portion and the first soldering portion, the first interconnecting portion extends downwards from the first retaining portion, a recessed first channel is disposed on a front end surface of the first body and runs to a bottom wall of the first retaining slot, and the first interconnecting portion is received in the first channel.

3. The card edge connector according to claim 1, wherein the first terminal further comprises a first interconnecting portion interconnecting the first retaining portion and the first soldering portion, the first interconnecting portion extends downwards from the first retaining portion and extends backwards, a recessed first channel is disposed on a front end surface of the first body and runs to a bottom wall of the first retaining slot, a recessed second channel is disposed on the bottom surface of the first body and in communication with the first channel, and the first channel and the second channel collectively receive the first interconnecting portion.

4. The card edge connector according to claim 1, wherein a third body extends forwards from the base body and is located above the second body, the second body, the third body, and the base body collectively enclose a second insertion space; and wherein multiple recessed third receiving slots are disposed on the second body, multiple recessed fourth receiving slots are disposed on the third body, and the third receiving slots and the fourth receiving slots are all in communication with the second insertion space.

5. The card edge connector according to claim 4, wherein the card edge connector further comprises multiple third terminals and multiple fourth terminals, each of the third terminals comprises a third contact arm received in the third receiving slot, each of the third contact arms has a third contact portion which enters the second insertion space, each of the fourth terminals comprises a fourth contact arm received in the fourth receiving slot, and each of the fourth contact arms has a fourth contact portion which enters the second insertion space.

6. The card edge connector according to claim 5, wherein the first contact arm and the third contact arm are coplanar.

7. The card edge connector according to claim 5, wherein a third soldering arm extends downwards from the third contact arm, enters the first body, and is located under the first contact arm, and the third soldering arm has a third soldering portion exposed on the bottom surface of the first body.

8. The card edge connector according to claim 7, wherein the first soldering portion is closer to the base body than the third soldering portion.

9. The card edge connector according to claim 1, wherein the first receiving slot is recessed backwards into the base body, and the first elastic section and a rear end of the first contact arm are received in the base body.

10. The card edge connector according to claim 1, wherein the first receiving slot runs to a top surface and a front end surface of the first body, the first retaining slot runs to the front end surface of the first body, and the first retaining portion urges against an upper wall surface and a lower wall surface of the first retaining slot.

* * * * *